US005441465A

United States Patent [19]

Hefner et al.

[11] Patent Number: 5,441,465

[45] Date of Patent: Aug. 15, 1995

[54] FLYING BALLET BARRE

[76] Inventors: Teresa C. Hefner, 12121 Cromwell, Dallas, Tex. 75234; David M. Jones, 2825 Lake Gardens, Irving, Tex. 75060

[21] Appl. No.: 321,213

[22] Filed: Oct. 11, 1994

[51] Int. Cl.[6] ..... A63B 1/00

[52] U.S. Cl. ..... 482/39; 482/69; 482/23

[58] Field of Search ..... 482/17, 23, 34, 38, 482/39, 41, 42, 43, 69, 148, 908, 904

[56] References Cited

U.S. PATENT DOCUMENTS

| | | | |
|---|---|---|---|
| 783,890 | 2/1905 | Reach | 272/62 |
| 1,085,486 | 1/1914 | Rosenberger | 272/62 |
| 2,812,944 | 11/1957 | Finch | 272/62 |
| 2,932,510 | 4/1960 | Kravitz | 272/62 |
| 3,563,539 | 2/1971 | Rogers | 482/41 |
| 4,126,307 | 11/1978 | Stevenson | 272/62 |
| 4,241,914 | 12/1980 | Bushnell | 272/136 |
| 4,272,070 | 6/1981 | Schachner et al. | 272/62 |
| 4,948,118 | 8/1990 | Miraglia | 482/55 |
| 5,221,240 | 6/1993 | Mann et al. | 482/42 |

FOREIGN PATENT DOCUMENTS

| | | | |
|---|---|---|---|
| 1651932 | 5/1991 | U.S.S.R. | 482/41 |

*Primary Examiner*—Stephen R. Crow
*Attorney, Agent, or Firm*—Harris, Tucker & Hardin

[57] ABSTRACT

A flying ballet barre assembly is mounted across the width of a room and supported by a lifting system capable of moving the entire ballet barre vertically between a position of use near the floor and a storage position near the ceiling. Opposite ends of the ballet barre are equipped with a slide which cooperates with a slide groove in an upright support at each side which guides and supports the ballet barre while it is raised and lowered. The lifting system is powered by an electric motor which is controlled by a switch. The flying ballet barre assembly can be quickly lowered for use and then raised to the storage position so that the room in which it is mounted can be used for other purposes. A particular advantage is the lateral flexibility with the long ballet barre supported from cables which provides a dancer with an instantaneous reaction to an improper position which provides the feedback necessary to learning.

20 Claims, 2 Drawing Sheets

FLYING BALLET BARRE

BACKGROUND OF THE INVENTION

1. Field of the Invention

The invention relates to an instructional and exercise aid for dancers, more particularly an improved ballet barre assembly which may be deployed across a room.

2. Background of the Prior Art

Exercise rooms in dance studios are most frequently multi-purpose rooms most notably for teaching ballet. Dance studios traditionally have bars, known as ballet barres, mounted along the wall for enabling ballet dancers to perform special exercises. These ballet barres are usually supported about one foot from the wall and may be fairly lengthy. Multiple ballet barres in vertical arrangement may be employed so that children of different age classes and height can use the one most appropriate for their size. Proper use of a ballet barre requires only a light touch to allow the dancer to maintain perfect balance during exercise movements. The barre is not supposed to be a support since the object is to teach the student how to center their own weight and be able to balance in a number of positions. Conventional barres that are anchored to the wall like concrete have very little or no give at all. Students can't tell when they're leaning too heavily on the barre.

The art recognizes that ballet barres extending from the wall undesirably encroach upon the available room space. U.S. Pat. No. 2,812,944 by Finch illustrates a folding ballet barre which can be folded flat against the wall to solve this problem. It is mounted with brackets to the wall surface and may be manually lifted and placed in another wall bracket to incrementally change the elevation.

U.S. Pat. No. 4,126,307 by Stevenson discloses a ballet barre which is removably attached to the wall by means of suction cups. U.S. Pat. No. 2,932,510 by Kravitz discloses a portable ballet barre which is fastened to the floor by means of cantilevered legs having suction cups at their extremities. The portable device may be disassembled or removed from the room and stored so that the room can be used for other purposes.

SUMMARY OF THE INVENTION

The present invention is referred to as a flying ballet barre assembly which may be installed across the entire open space of a dance studio room, not just at a wall. The ballet barre is easily raised to the ceiling where it is stored out of the way. The opposite ends of the ballet barre have side assemblies connected to the ballet barre at each end. The side assemblies include a glide block adapted to slide in an upright support at each side. The upright supports are mounted in vertical orientation at opposite sides of the room to support the flying ballet barre. A lifting system is connected to the glide blocks and/or the ballet barre itself for selectively raising and lowering the ballet barre while it is being guided and supported by the glide blocks. The upright supports position the ballet barre across the open space of a room at a selected elevation suitable for exercising and guide it while it is raised or lowered.

The lifting system is conveniently mounted in the space above the ceiling of the room. Supporting lines or cables connected to the glide blocks and/or the ballet barre, feed over pulleys to a yoke which is preferably operated by the mechanism of an electric garage door opener. In response to a switch, the entire ballet barre is quickly and effortlessly raised to the ceiling of the room by the lifting system where it is stored out of the way and does not interfere with other uses of the room. When it is desired to engage in ballet exercises, operation of the switch quickly and easily lowers the unit to a position for use. The assembly includes a means for adjusting the position of use for dancers of different height.

A very substantial additional advantage is gained by the assembly of the present invention because of its long length and the way it is suspended instead of being rigidly attached at a wall. There is a significant amount of give in a lateral direction which signifies to the dancers when they're leaning too heavily on a barre. If a dancer leans right, left, front or back far enough to make them pull on the barre, the barre moves because it is held only at its ends and suspended from cables across the middle. The over-all result is a remarkably light touch on the barre as the dancer is forced to find their center of balance. The instantaneous awareness of the body position which is provided by the flying ballet barre assembly is a major benefit provided by the structure.

DETAILED DESCRIPTION OF THE PREFERRED EMBODIMENT

Figure 1:
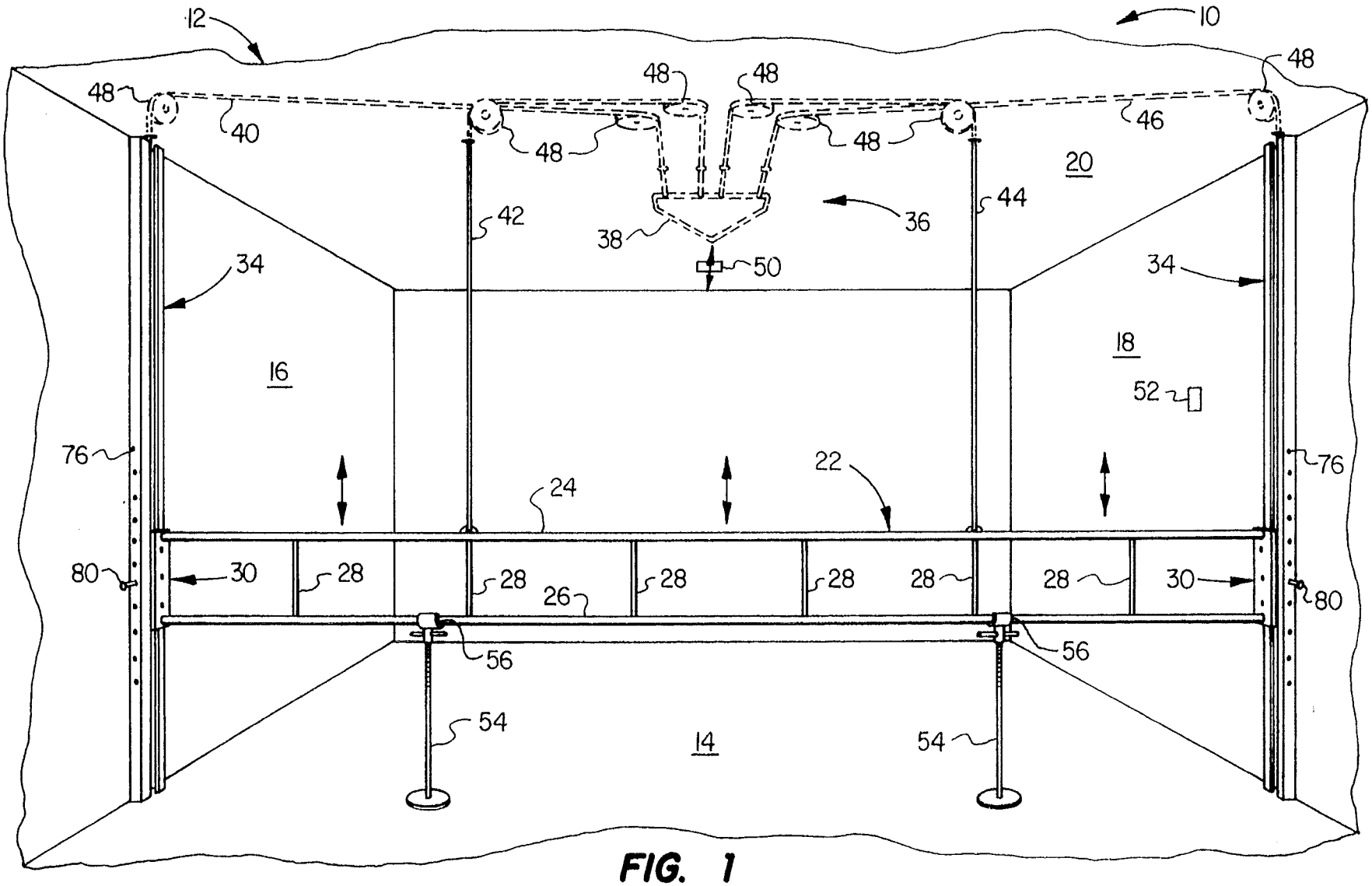
FIG. 1 shows the flying ballet barre assembly with the ballet barre shown in a position for use.

The flying ballet barre assembly is indicated generally by the reference numeral 10. In FIG. 1, it is assembled in the exercise room 12 of a dance studio. Room 12 has a conventional floor 14, side walls 16 and 18, and a ceiling 20. Ballet barre 22 comprises an upper barre 24 and a lower barre 26. A series of supports 28 are connected to barres 24, 26 to space them apart. A pair of side assemblies 30 are connected to the opposite ends of ballet barre 22. Each side assembly includes a glide block 32 shown in FIG. 2.

The glide blocks 32 are adapted to slide in cooperation in an upright support 34 mounted at opposite walls of the room and extending a substantial distance upwardly toward the ceiling of the room. The upright supports shown in FIG. 1 actually extend the full distance between the floor and ceiling, although the full distance is not necessarily required as long as the support for the guide block is provided by the upright supports over the distance that the ballet barre has to travel.

A lifting system generally designated by the reference numeral 36 is connected to the side assemblies and/or the ballet barre 22 for selectively raising and lowering the ballet barre while it is being guided and supported by the upright supports. The lifting system thereby positions the ballet barre across the open space of the room at a selected elevation suitable for exercises or raises the ballet barre to a storage position near the ceiling so that the open space of the room is unobstructed for other uses. As illustrated, the lifting system comprises a yoke 38 connected to a plurality of cables 40, 42, 44 and 46 which cooperate with pulleys 48 to raise and lower ballet barre 22. Cables 40 and 46 are each preferably connected to a glide block 32 while cables 42 and 44 are preferably connected to ballet barre 22. The number of cables and the spacing of cables is a matter of choice.

Ballet barre 22 moves vertically while yoke 38 in cooperation with pulleys 48 moves horizontally. Motive power for yoke 38 is provided by a conventional electric garage door opener assembly 50 which includes a conventional loop chain, sprockets, and a reversible electrically operated gear reducing motor (not shown) drivingly engaging a sprocket and operated by a conventional key switch 52. Conventional limit switches provided with the opener assembly are located to trip to stop the motor when the ballet barre is raised to the storage or lowered to a predetermined position near the floor. A pair of any suitable adjustable supports 54 having cradles 56 at their upper end in contact with barre 26 can help support ballet barre 22 and enable fine adjustments of its height be made.

Figure 2:
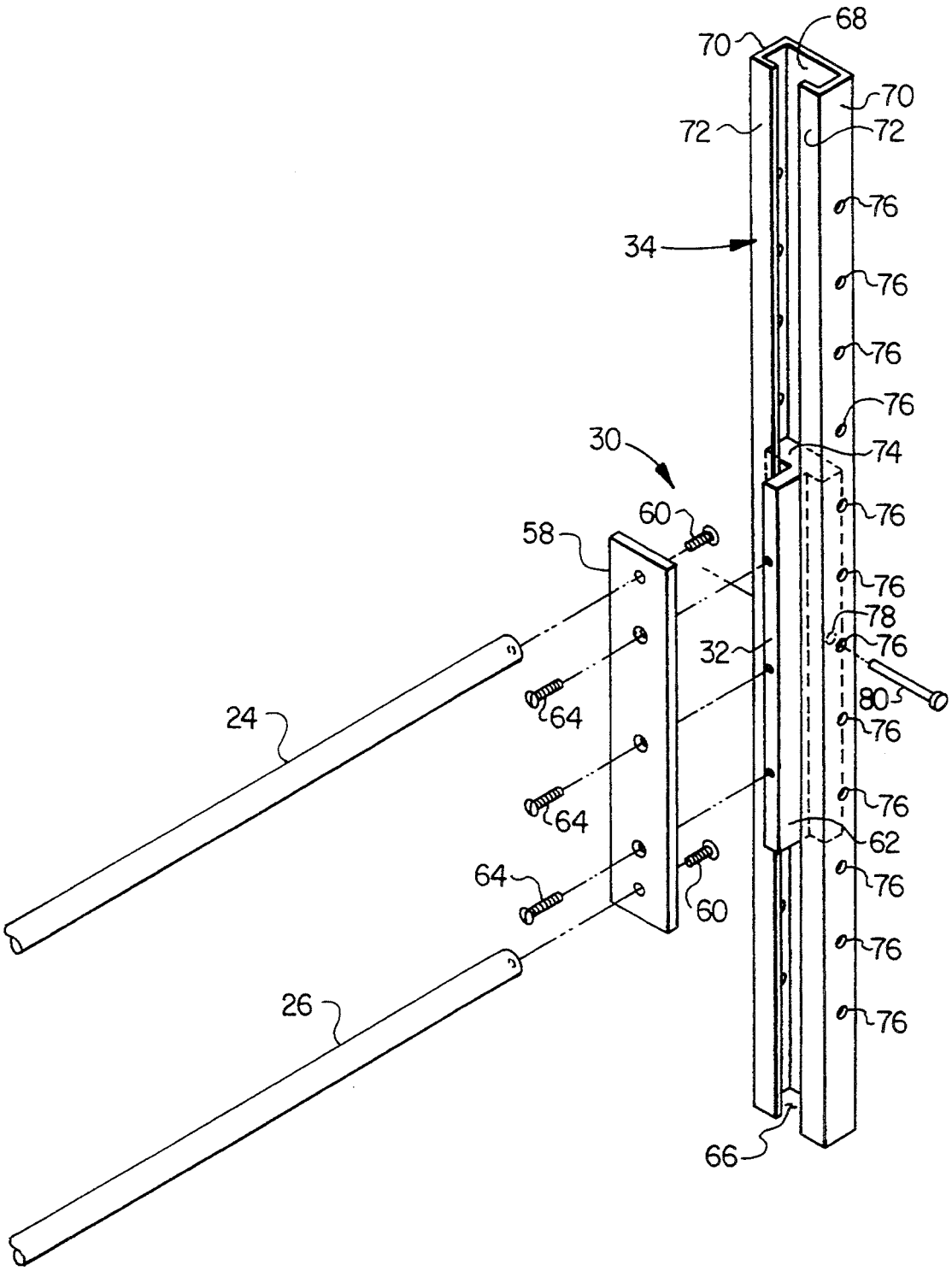
FIG. 2 has a perspective detail of a side assembly showing the ends of the ballet barre, the upright and the sliding glide block.

Referring now to FIG. 2, the side assemblies 30 include an end plate 58 which is fixed to the ends of barres 24, 26 by fasteners 60 through openings in plate 58. End plate 58 is removably fixed to the web 62 of glide block 32 by fasteners 64 through openings in end plate 58. Upright support 34 has a glide channel 66 through which web 32 protrudes. Upright support 34 preferably has a "C"-shaped cross section which includes a back 68, opposite sides 70, and flanges 72, all of which comprises an internal open space in which glide block 32 is guided and supported for vertical movement therealong. Glide block 32 has a generally "T" shaped cross section which includes a stem or web portion 62 and a head portion 74.

Glide block 32 is conventionally provided with suitable beatings or roller bearings (not shown) which protrude from its surfaces which are contained in the open space within upright support 34 to reduce friction and prevent binding between glide block 32 and upright 34 due to slight variations in the straightness, waviness, wall thicknesses and other manufacturing attributes of the combined parts. A "sloppy" fit between these parts should be avoided so that the barre is relatively firmly held since a loose or "floppy" reaction to slight lateral forces does not occur. It should be understood that the term slide or slidingly mounted includes sliding friction surfaces or rolling beatings or similar arrangements which allow the glide blocks to move freely with respect to the upright supports.

Upright supports 34 are provided with a series of transverse openings 76 which extend laterally through the sides 70 at spaced intervals. Glide block 32 includes an opening 78 positioned to align with any of the openings 76 and is secured by a pin 80. Pin 80, together with openings 76, 78 provide a means for selectively adjusting the elevation of glide blocks 32 and the ballet barre 22. With the pins 80 in place, side assemblies 30 together with ballet barre 22, are fixed at a particular elevation. Pins 80 are removed before the ballet barre is raised to the storage position.

A flying ballet barre assembly can be positioned across the center of an exercise room or two of the flying ballet barre assemblies can be spaced along the length of the room to divide the room into three or more exercise spaces to accommodate more students. It is evident that the students can be placed on both sides of the ballet barre to allow more room for exercising. The ballet barre can be located adjacent the end of a room in which case the lifting system would be positioned on the opposite side from that illustrated in FIG. 1 to allow room for its operation.

In a prototype installation, ballet barre 22 extends across a 35 foot wide room. Barres 24, 26 are wooden barres of a conventional design which provide the proper give and feel. Depending upon the size of the dancers, the ballet barre is positioned roughly 30" to 52" above the floor. It is preferable to provide the adjustable supports 54 approximately every 10 feet along the barre to add some stability and support the barre in a vertical direction. Ballet barre 22, together with the side assemblies 30, weighs approximately 50 pounds. The prototype can move about 5 to 6 inches in a lateral direction by bending when pushed.

Upright supports 34 are preferably made of rolled or extruded metal containing a longitudinal opening in which at least a portion of a glide block 32 is received and slidingly supported therein. It preferably includes a turned over flange which stabilizes the glide blocks and prevents the ends of the ballet barre from moving laterally or pulling away from the upright supports. It is really appreciated that stops can be provided in the upright supports which interfere with downward motion of the glide block so that it cannot be lowered below a minimum desired level. These could be formed by blocks molded or welded into the lower part of the upright support or by the simple expedient of using another pin 80 to establish a position below which the glide block cannot travel.

The outermost cables 40, 46 are preferably connected to the glide blocks and extend down through the opening 66 of upright supports 34 to provide a direct pull on the glide blocks. Care is taken with the length of these cables so that the ballet barre is positioned horizontally without any tendency to cock which could cause binding in the upright supports when it is raised and lowered.

Although the yoke 38 could be attached to a cable and pulleys leading to a manually operated drum with a ratchet to prevent the ballet barre from dropping while it is being raised, it is far preferable to employ an electric motor equipped with a worm gear reducer which is turned off and on by switch 52. Switch 52 is preferably operated by a key so that only an authorized person can raise or lower it. The operating assembly of a garage door opener has been found ideal for this purpose and in the prototype, an inexpensive ½ horsepower garage door opener assembly made by Stanley Home Products and identified as model 5T369, has been found more than adequate. The operating assembly of the garage door opener moves a connector along a linear path. The connector is connected to the yoke. The opener assembly has a continuous loop sprocketed chain approximately 8–10 feet long which moves the connector along a linear path to provide sufficient linear travel to move the yoke 38 the amount of travel necessary to raise and lower the ballet barre 22. The motor is reversible and can be "bumped" by rapid operation of switch 52 to move short distances. As is conventional the switch starts the motor, stops the motor, then starts the motor in the reverse direction as it is sequentially operated.

Because the ballet barre does not need to be lifted manually, no counterweights or countersprings are required. The end may be moved a short distance by hand in order to line up the openings so that the pin 80 can be inserted. The garage door opener assembly is ideally suited for the application because it is already equipped with the necessary switches and reversing devices that enable it to move a specified distance in one direction where it is stopped by a limit switch. When the action is initiated again, it moves a certain distance in the reverse direction until it trips another limit switch. It then stops ready for movement in the opposite direction when initiated again. The switch can also stop the opener assembly at any place between the limit switches.

Other means of raising and lowering the ballet barre are easily visualized. One such mechanism would be a drum which wraps a cable connected to the yoke, driven by an electric motor through a worm gear. A non-reversing motor could be employed on the drum and it could be equipped with a brake to control lowering. Another such means is a long screw which is equipped with a ball unit which moves along linearly when the screw is rotated. This ball unit could be attached to the yoke and driven by the reversible motor. Such a unit is a garage door opener sold under the Genie brand in home improvement stores. The garage door opener is mass-produced and extremely economical and available everywhere. It will be appreciated and many other variations can be visualized without departing from the spirit and principle of the invention.

We claim:

1. A flying ballet barre assembly which is installed across the open space of a dance studio room having an open space defined by a floor, a ceiling and opposite walls, comprising:

a ballet barre extending substantially from wall to wall across the open space of the room;

a pair of side assemblies comprising a side assembly connected to each end of said ballet barre, each side assembly having a glide block adapted to slide in cooperation with an upright support;

a pair of said upright supports for the ballet barre comprising an upright support mounted at opposite walls of the room and extending a substantial distance upwardly toward the ceiling, each upright support having a glide channel extending therealong with which one of said glide blocks slidingly cooperates so that said ballet barre can be guided and supported;

a lifting system connected to said side assemblies and/or the ballet barre for selectively raising and lowering the ballet barre while it is being guided and supported by the upright supports thereby positioning the ballet barre across the open space of the room at a selected elevation suitable for exercises or raising it up to a storage position near the ceiling so that the open space of the room is unobstructed for other uses.

2. The assembly of claim 1 further including a means for securing the ballet barre in any one of several selected elevations suitable for exercising.

3. The assembly of claim 2 wherein the said means for securing comprises selective pinned connections between said side assemblies and said upright supports which removably secure the ballet barre at a selective elevation for use.

4. The assembly of claim 3 further comprising one or more adjustable means for support which are placed under the ballet barre to prevent sagging.

5. The assembly of claim 4 wherein said adjustable means for support comprise one or more removable floor mounted stands which are positioned under the ballet barre.

6. The assembly of claim 1 wherein said lifting system comprises a pulley and cable harness located near the ceiling from which a plurality of cables descend in order to raise or lower the ballet barre.

7. The assembly of claim 6 wherein said cable harness is a motor driven cable harness which selectively raises the ballet barre by operation of the motor.

8. The assembly of claim 7 wherein said plurality of descending cables include a cable from the cable harness on each side which is attached to some portion of the side assembly.

9. The assembly of claim 8 wherein said cable from the cable harness on each side which is attached to some portion of the side assembly extends downwardly through the upright support on each side and is attached to the respective glide block therein.

10. A flying ballet barre assembly which is installed across the open space of a dance studio room having an open space defined by a floor, a ceiling and opposite walls, comprising:

a ballet barre extending substantially from wall to wall across the open space of the room;

a pair of side assemblies comprising a side assembly connected to each end of said ballet barre, each side assembly having a glide block adapted to slide in an upright support;

a pair of said upright supports for the ballet barre comprising an upright support mounted at opposite walls of the room and extending a substantial distance upwardly toward the ceiling, each upright support having a glide channel extending therealong in which one of said glide blocks is slidingly received so that said ballet barre can be guided and supported;

means for securing the ballet barre in a selected elevation suitable for exercising; and a lifting system connected to said side assemblies and/or the ballet barre for selectively raising and lowering the ballet barre while it is being guided and supported by the upright supports thereby positioning the ballet barre across the open space of the room at a selected elevation suitable for exercises or raising it up to a storage position near the ceiling so that the open space of the room is unobstructed for other uses.

11. The assembly of claim 10 wherein each of said upright supports comprise elongated channel sections with an open face facing toward the ballet barre and one of said glide blocks slide in each of said elongated channel sections.

12. The assembly of claim 11 wherein said glide blocks each have a T-shaped cross section wherein the head of the T-shaped section slides in said elongated channel section and the stem of said T-shaped section is a web which projects from the open face of the channel section and is connected to a plate member together comprising the side assembly to which each end of the ballet barre is attached.

13. The assembly of claim 11 wherein the elongated channel sections have edges at said open face which serve to retain said glide blocks therein.

14. The assembly of claim 11 wherein the means for securing the ballet barre at a selected elevation for exercising comprises a series of vertically spaced openings in the elongated channel sections and at least one corresponding opening in the respective glide blocks which may be locked in position at a plurality of selected elevations by means of a removable pin.

15. The assembly of claim 14 wherein said elongated channel sections which comprise the upright supports extend substantially from floor to ceiling.

16. The assembly of claim 15 wherein said glide blocks each have a portion which extends downwardly, which encounters a stop surface when the ballet barre is lowered down wherein said stop surface and said downwardly extending portion together establish the lowest position of the ballet barre beyond which it cannot drop.

17. A flying ballet barre assembly which is installed across the open space of a dance studio room leaving an open space defined by a floor, ceiling and office and walls, comprising:

a ballet barre extending substantially from wall to wall across the open space of the room;

a pair of side assemblies comprising a side assembly connected to each end of said ballet barre, each side assembly being fitted with a glide block;

a pair of upright supports for the ballet barre, one for each side, mounted oppositely on opposite walls of the room, each upright support having a glide channel in which one of said glide blocks is slidingly mounted so that said ballet barre is guided and supported;

a motorized lifting system connected to said side assemblies and/or the ballet barre comprising flexible cables connected to a yoke which is selectively moved by a reversible motor assembly for selectively raising and lowering the ballet barre between a use position near the floor and a storage position near the ceiling so that the open space of the room is unobstructed for other uses.

18. The assembly of claim 17 wherein the motorized lifting system includes a reversible motor drivingly connected to a gear reducer which drives a movable connector connected to said yoke along a linear path of sufficient length to provide a full range of travel for the ballet barre between said use position and said storage position.

19. The assembly of claim 17 wherein said reversible motor assembly comprises drive components of a common garage door opener, comprising a reversible motor drivingly connected through a gear reducer to a means for converting the rotary output of the gear reducer to linear motion and a connector which moves along a linear path wherein the yoke is connected to the connector and thereby moved in response to operation of said reversible motor assembly.

20. The assembly of claim 17 wherein said motorized lifting assembly is mounted above said ceiling out of view.

* * * * *